US011957235B2

(12) United States Patent
Tilley

(10) Patent No.: US 11,957,235 B2
(45) Date of Patent: Apr. 16, 2024

(54) CARE CLIP FOR HANDHELD DEVICES

(71) Applicant: Brian Tilley, Sacramento, CA (US)

(72) Inventor: Brian Tilley, Sacramento, CA (US)

(73) Assignee: Brian Reed Tilley, Sacramento, CA (US)

( * ) Notice: Subject to any disclaimer, the term of this patent is extended or adjusted under 35 U.S.C. 154(b) by 361 days.

(21) Appl. No.: 17/520,945

(22) Filed: Nov. 8, 2021

(65) Prior Publication Data

US 2023/0146479 A1 May 11, 2023

(51) Int. Cl.
*A45F 5/00* (2006.01)
*A45F 5/02* (2006.01)

(52) U.S. Cl.
CPC ..... *A45F 5/004* (2013.01); *A45F 5/021* (2013.01); *A45F 2200/0516* (2013.01)

(58) Field of Classification Search
CPC ..... Y10S 224/93; A45F 2200/0516; A45F 2005/006; A45F 2200/0508; A45F 5/00; A45F 5/004; A45F 2200/0525; A45F 2200/055; H04B 1/3888
USPC ..... 224/162, 930
See application file for complete search history.

(56) References Cited

U.S. PATENT DOCUMENTS

| | | | | |
|---|---|---|---|---|
| 2,176,253 | A * | 10/1939 | Fogarty | A45C 13/42 D11/79 |
| 5,938,137 | A | 8/1999 | Poulson | |
| 9,605,696 | B1 * | 3/2017 | May | H01F 7/0263 |
| 9,629,447 | B1 * | 4/2017 | Martel | A45F 5/004 |
| D830,054 | S | 10/2018 | Zagorski | |
| 10,455,927 | B2 * | 10/2019 | Brousseau | B25G 3/00 |
| 10,693,517 | B2 * | 6/2020 | Osmanski | A45C 11/00 |
| 10,790,868 | B1 * | 9/2020 | Tsai | A45F 5/00 |
| 2003/0042348 | A1 | 3/2003 | Salentine et al. | |
| 2012/0080469 | A1 * | 4/2012 | Souders | H04B 1/3888 224/191 |
| 2013/0146635 | A1 * | 6/2013 | Hedrick | A45F 5/00 428/41.7 |

* cited by examiner

*Primary Examiner* — Adam J Waggenspack

(57) ABSTRACT

A clip device includes a membrane body having a flat surface and a tapered end fixed to the membrane body. The tapered end is clipped to a retractable cord. The flat surface of the membrane body is sandwiched between a case of a handheld device and the handheld device and the tapered end has a portion protruding from the case through an opening of the case.

6 Claims, 10 Drawing Sheets

CARE CLIP FOR HANDHELD DEVICES

FIELD

The disclosed embodiments relate generally to a clip and a clip extension and in particular, but not exclusively, to a care clip for handheld devices.

BACKGROUND

A handheld device is any portable device that can be carried and held in a person's palm. A handheld device can be any computing or electronic device that is compact and portable enough to be held and used by one or both hands. A handheld device can contain cellular communication, such as a cellular mobile phone, a tablet computer, or other computing devices.

The current trend for handheld devices takes the form factor of a slab, block, or bar, usually in a rectangular shape with rounded corners and/or edges for a minimalist appeal. With such a form factor, a person can easily misplace, drop, or have the handheld device stolen. Dropping the device may require repairs. Misplaced/stolen devices can lead to personal or corporate privacy/data leaks, identify fraud, fraudulent purchases, bank frauds, etc. when the handheld devices are compromised.

SUMMARY

Embodiments of a clip or clip with extension for a handheld device is disclosed to prevent the handheld device being misplaced, dropped, or stolen.

According to a first aspect, a clip device includes a membrane body having a flat surface and a tapered end fixed to the membrane body. The tapered end is clipped to a retractable cord. The flat surface of the membrane body is sandwiched between a case of a handheld device and the handheld device and the tapered end has a portion protruding from the case through an opening of the case.

For one embodiment, the flat surface has a surface area larger than the opening of the case.

For one embodiment, the tapered end includes a hole and the tapered end is clipped to the retractable cord by inserting a portion of the retractable cord through the hole of the tapered end.

For one embodiment, the hole has a diameter approximately 0.3 centimeters.

For one embodiment, the tapered end includes an alligator clip and the alligator clip is clipped to a portion of the retractable cord.

For one embodiment, the membrane body has a thickness of approximately 0.036 centimeters.

For one embodiment, the membrane body is rectangular shaped having a dimension of approximately 1.5 centimeters by 6 centimeters, and the rectangular shape is sandwiched between the case of the handheld device and the handheld device.

For one embodiment, the portion of the tapered end has a thickness of approximately 0.225 centimeters.

For one embodiment, a thickness of the portion of the tapered end tapers towards a thickness of the membrane body.

For one embodiment, the opening of the case corresponds to a physical port of the handheld device.

For one embodiment, the physical port includes a charging port or a headphone port of the handheld device.

For one embodiment, the physical port includes a charging port or a headphone port of the handheld device.

For one embodiment, a charging cord is plugged to a charging port of the handheld device through the opening of the case and the tapered end protrudes from a same opening of the case.

For one embodiment, the tapered end is clipped to a first end of the retractable cord and a second end of the retractable cord is attached to a belt or an article of clothing of a person.

According to a second aspect, a clip extension for a handheld device includes a retractable cord having an extendable portion and a clip device attached to the retractable cord. The clip device includes a membrane body having a flat surface and a tapered end fixed to the membrane body. The tapered end is clipped to a retractable cord. The flat surface of the membrane body is sandwiched between a case of a handheld device and the handheld device and the tapered end has a portion protruding from the case through an opening of the case.

For one embodiment, the flat surface has a surface area larger than the opening of the case.

For one embodiment, the tapered end includes a hole and the tapered end is clipped to the retractable cord by inserting a portion of the retractable cord through the hole of the tapered end.

For one embodiment, the hole has a diameter approximately 0.3 centimeters.

For one embodiment, the tapered end includes an alligator clip and the alligator clip is clipped to a portion of the retractable cord.

For one embodiment, the tapered end is clipped to a first end of the retractable cord and a second end of the retractable cord is attached to a belt or an article of clothing of a person.

BRIEF DESCRIPTION OF THE DRAWINGS

The appended drawings illustrate examples and, therefore, are exemplary embodiments, and not to be considered limiting in scope.

DETAILED DESCRIPTION

Figure 1:
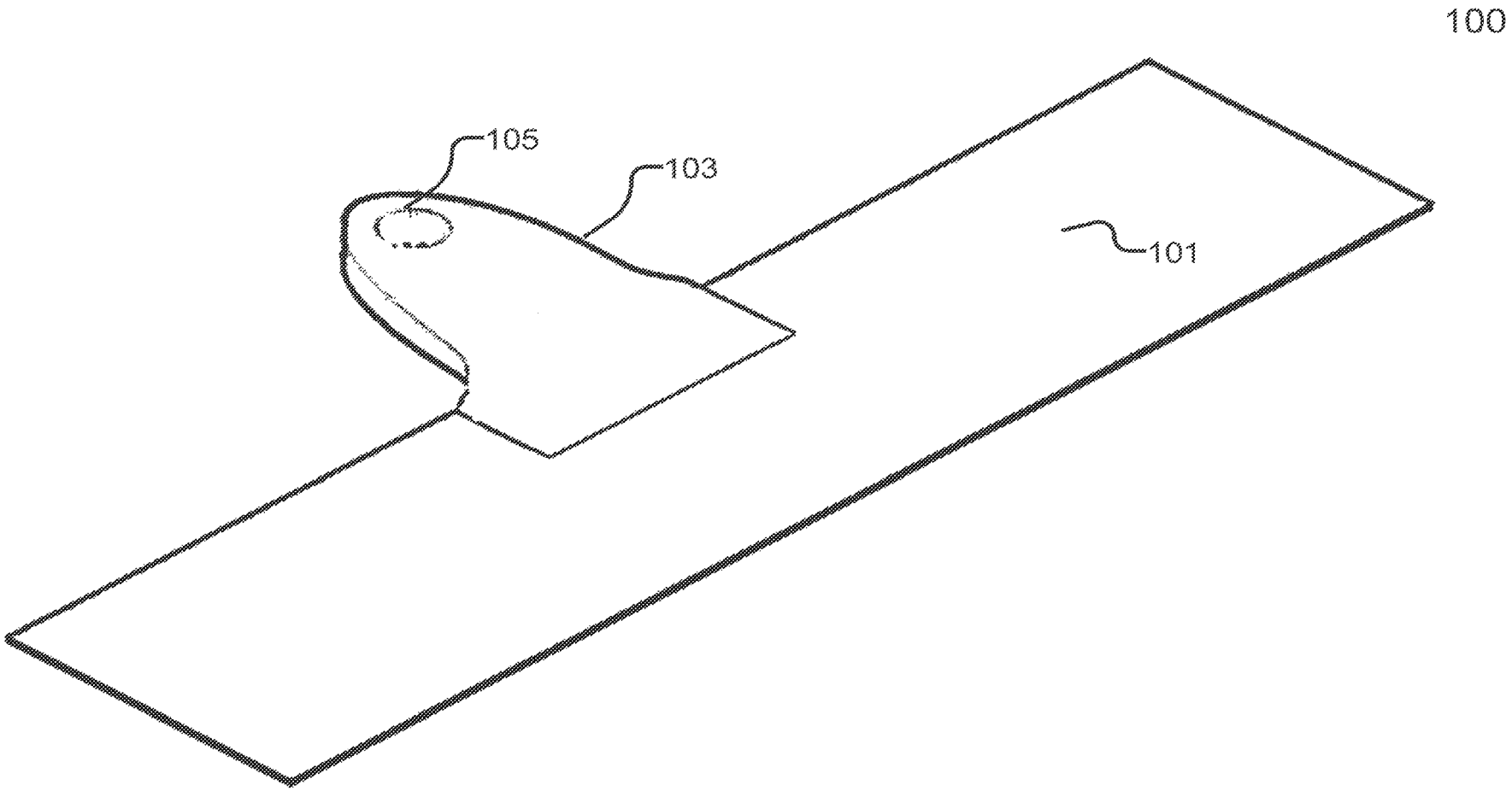
FIG. 1 illustrates a perspective view of a clip device according to one embodiment.

FIG. 1 illustrates a perspective view of a clip device according to one embodiment. Referring to FIG. 1, clip device 100 includes a membrane body 101 and a tapered end 103. The membrane body 101 can include a polymer membrane such as a polyurethane (plastic) membrane or any other membrane, e.g., metal, wood fiber, glass, Polylactic acid (PLA), Acrylonitrile butadiene styrene (ABS), Polyethylene terephthalate glycol (PETG), etc. Membrane body 101 can have a rectangular shape, circular shape or any other shape. Membrane body 101 can be stiff or bendable. For one embodiment, membrane body 101 is a biodegradable material. For one embodiment, membrane body 101 can include a uniform color, colored portions, or a camouflage color. The colored portions can be portions of any shapes and sizes. Membrane body 101 can include drawings/printings of a stylish imagery or other prints. For one embodiment, membrane body 101 can have a thickness of approximately 0.036 centimeters.

Tapered end 103 can include a hole 105 at a portion of tapered end 103. For another embodiment, tapered end 103 can include an alligator clip (not shown) at the portion of tapered end 103. For one embodiment, tapered end 103 and membrane body 101 can be a single piece or two separate pieces fabricated by an additive fabrication technique such as a three-dimensional (3D) printer. For separate pieces, tapered end 103 can include a strip of adhesive adhering tapered end 103 to a surface of membrane body 101. The adhesive may be any types of permanent adhesives, such as, super glue, guerilla glue, gel, wax, etc.

Figure 2:
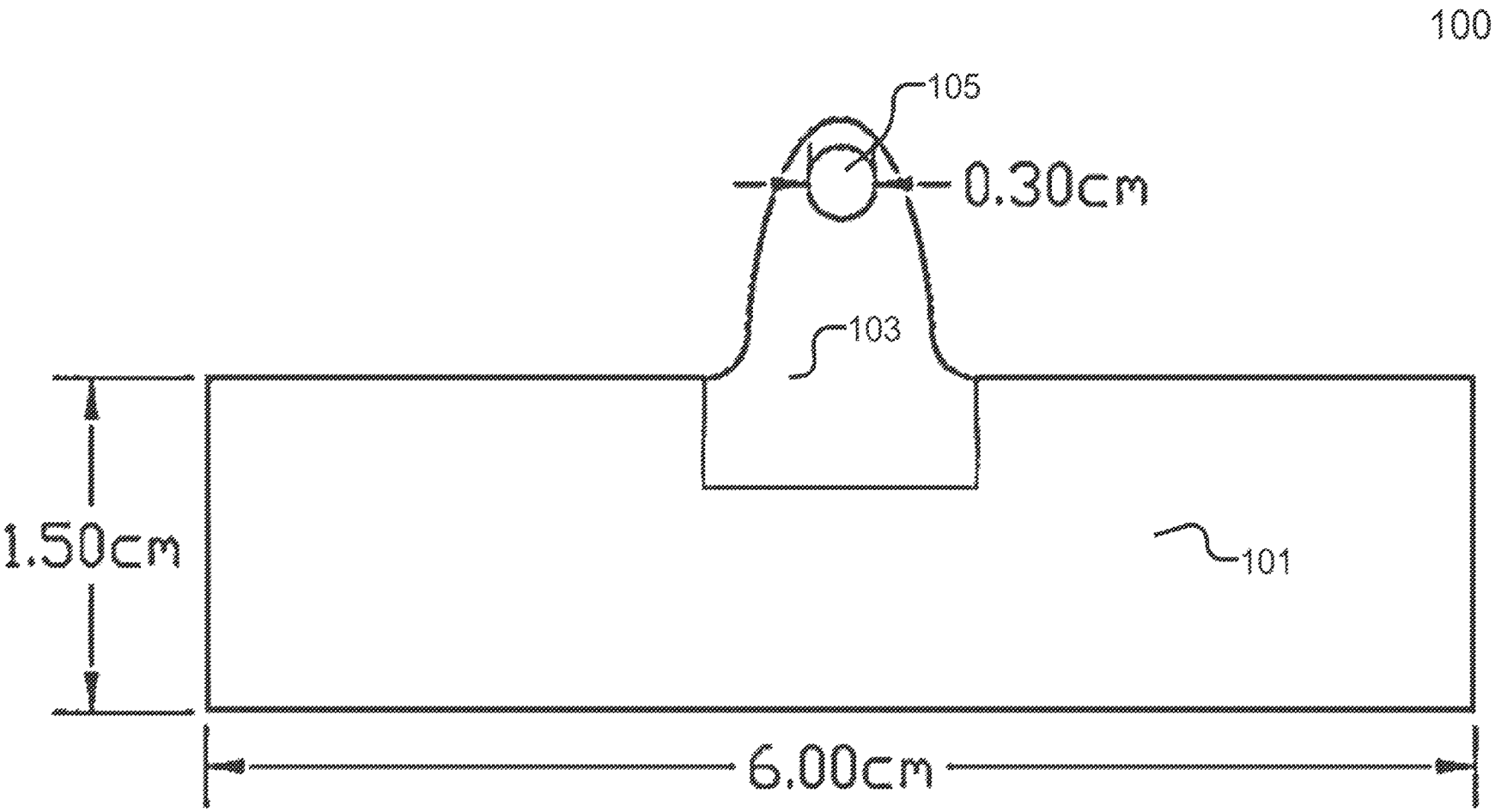
FIG. 2 illustrates a top view of a clip device according to one embodiment.

FIG. 2 illustrates a top view of a clip device according to one embodiment. Referring to FIG. 2, membrane body 101 can have a form factor of approximately 1.5 centimeters by approximately 6 centimeters. Hole 105 can have a diameter approximately 0.3 centimeters.

Figure 3:
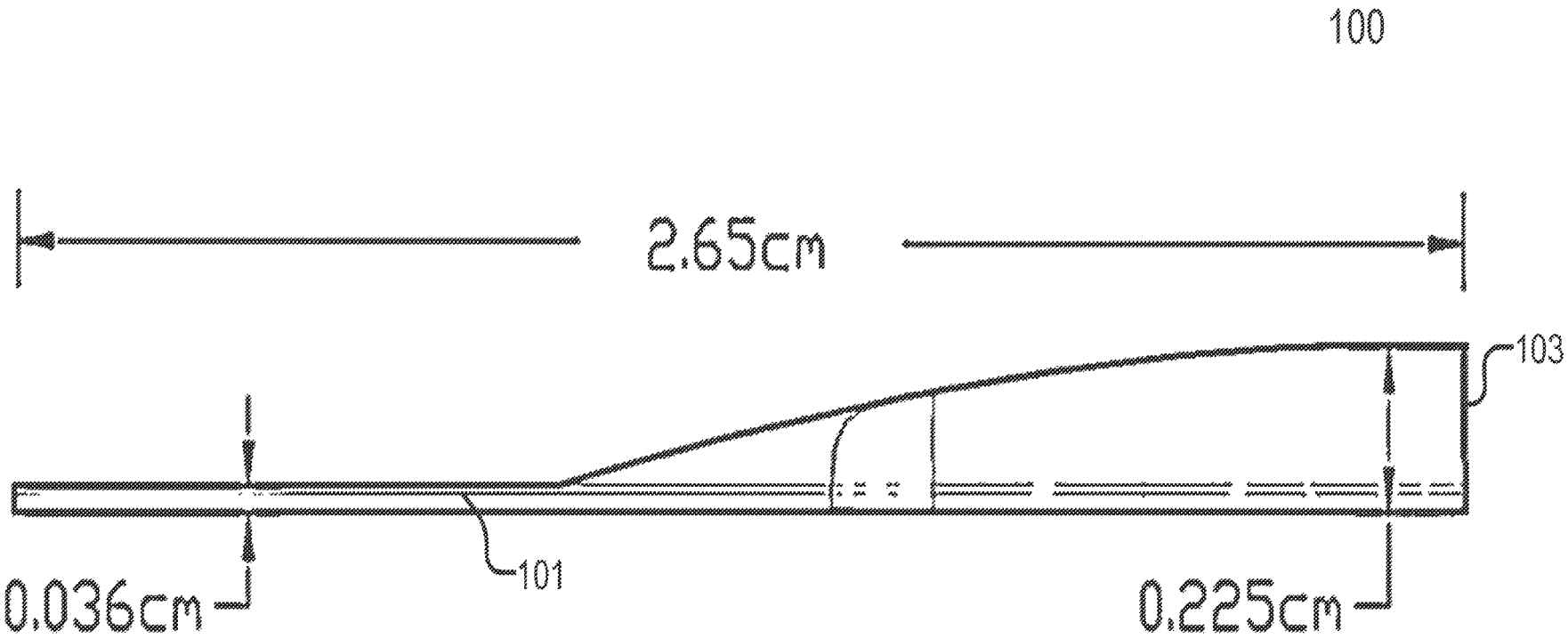
FIG. 3 illustrates a side view of a clip device according to one embodiment.

For one embodiment, the tapered end 103 includes a straight cutoff. For one embodiment, tapered end 103 has a gradual taper to reduce a chance of torn separating tapered end 103 from membrane body 101 as shown in FIG. 3. A portion of tapered end 103 can have a thickness of approximately 0.225 centimeters. The thickness of the portion of the tapered end 103 can taper towards a thickness of membrane body 101. For one embodiment, membrane body 101 has a thickness of approximately 0.036 centimeters. For one embodiment, a length of tapered end 103 and membrane body 101 is approximately 2.65 centimeters.

Figure 4:
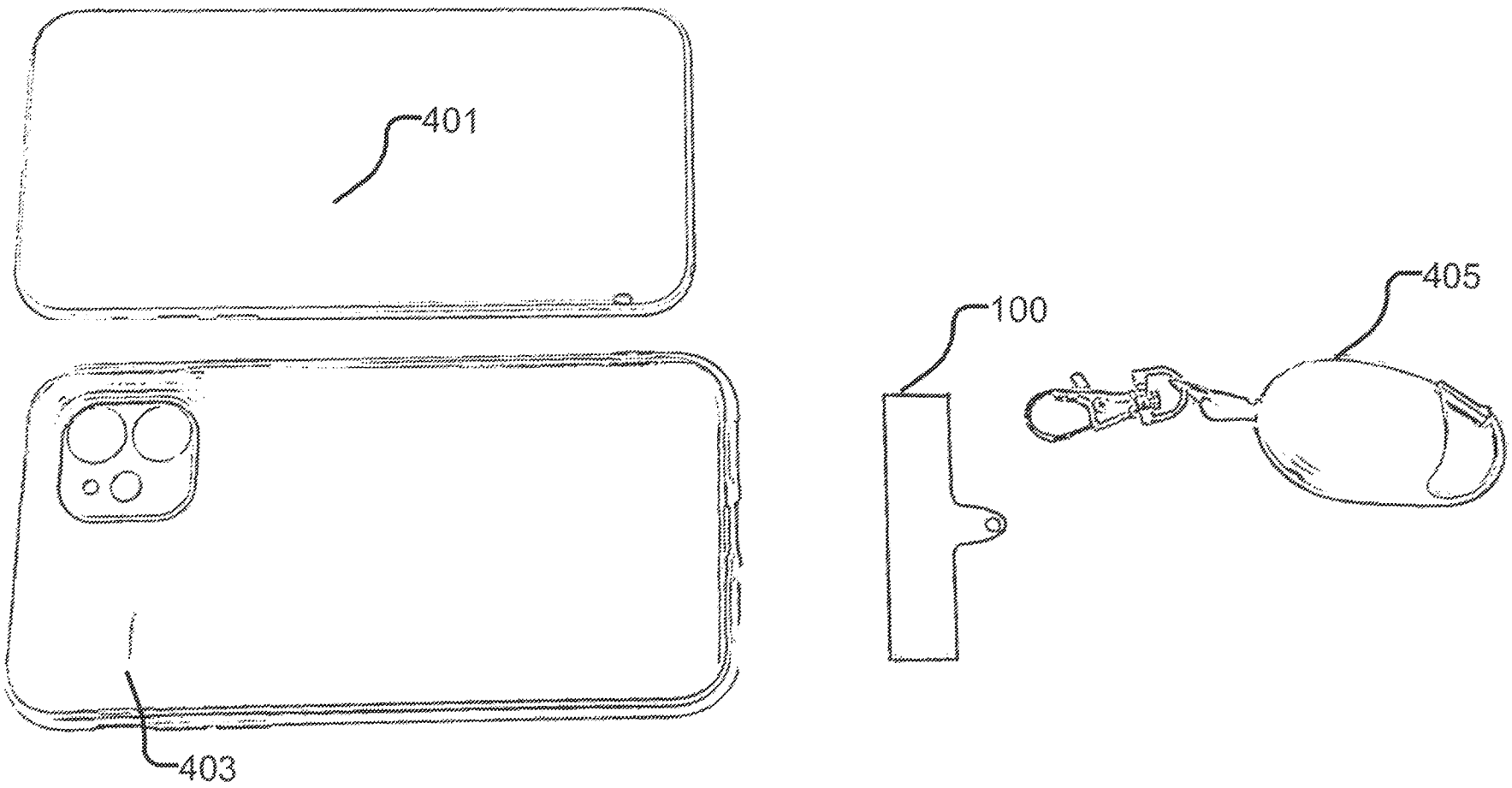
FIG. 4 illustrates a handheld device, a case, a cord, and a clip device according to one embodiment.

FIG. 4 illustrates a handheld device 401, a case 403, a cord 405, and a clip device 100 according to one embodiment. Cord 405 can be a retractable cord that is typically attached to a chain of keys, an identification card, a transit pass, a public transit card, a card key, and/or a business card, etc. Handheld device 401 can be any type of palm sized mobile devices such as an iPod©, iPhone©, iPad©, an android phone. Although handheld device 401 is shown as a mobile device, handheld device can be a tablet, an electronic book reader, etc. Case 403 can be a generic device protector that is fitted on handheld device 401.

Figure 5:
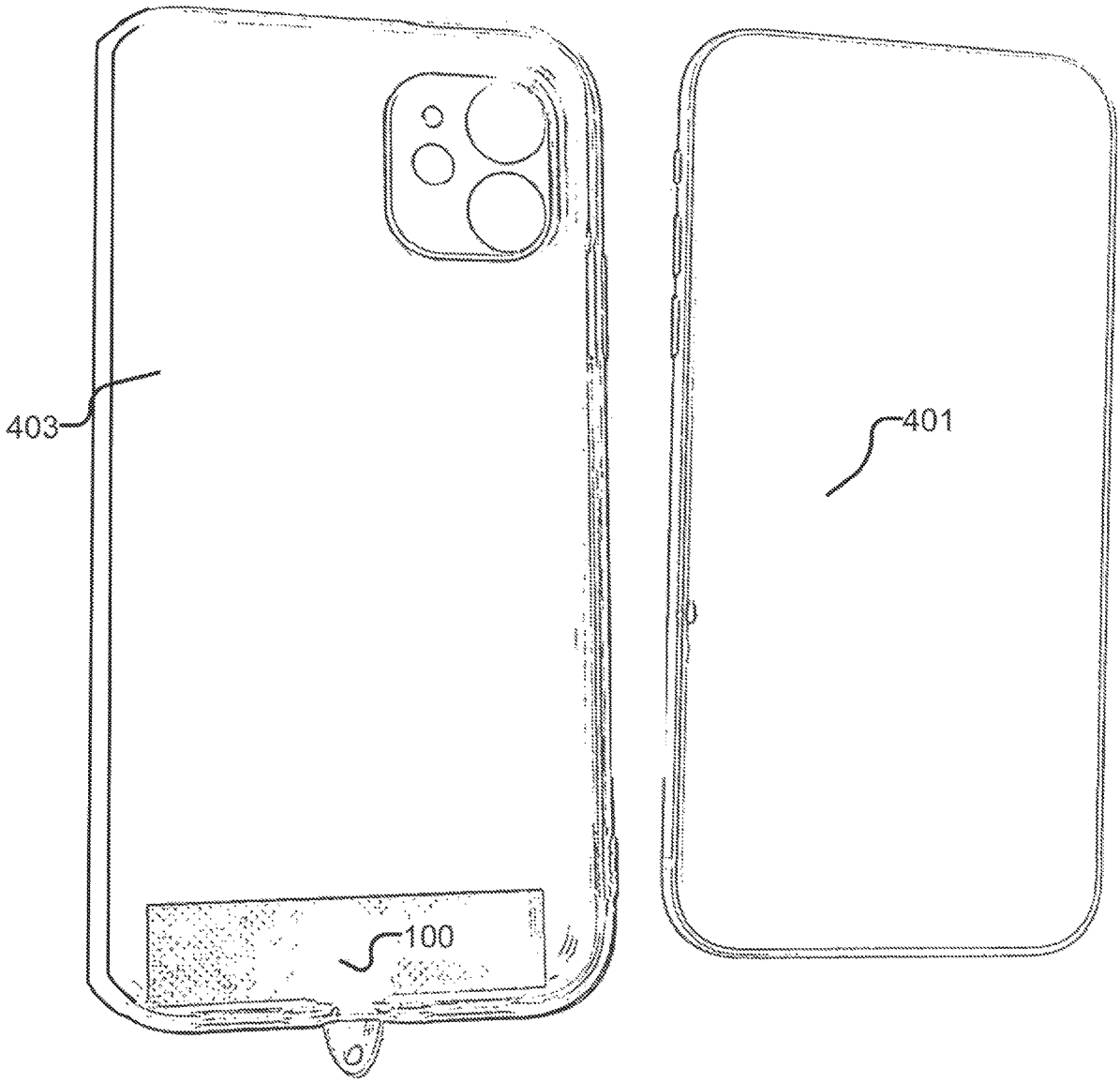
FIGS. 5-7 illustrate the steps to attach a clip device to a handheld device.
Figure 6:
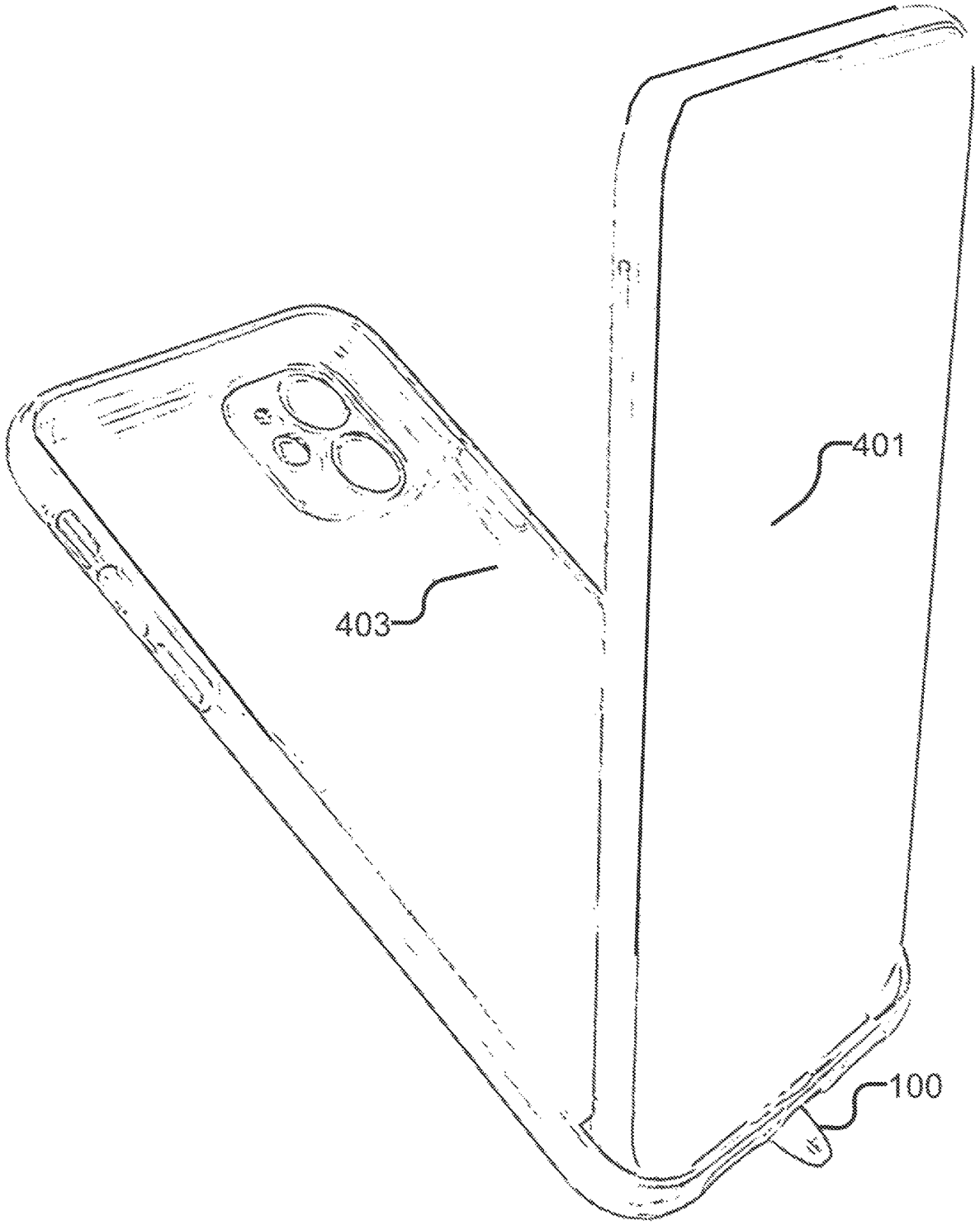
Figure 7:
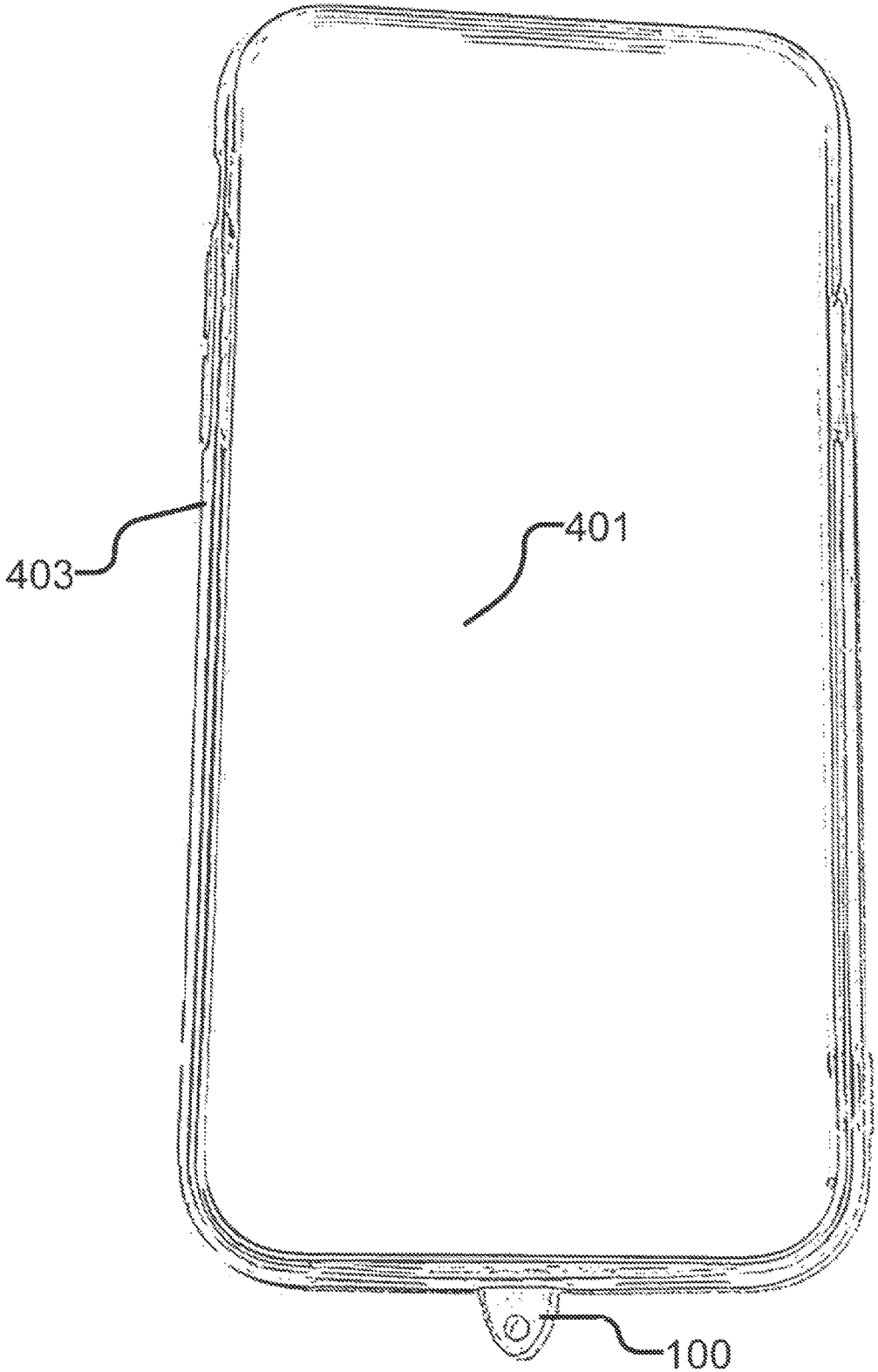

As shown in FIG. 4, clip device 100 is separable from handheld device 401, case 403, and retractable cord 405. When installed, a first end of clip device 100 can be attached to handheld device 401 via case 403, and a second end of clip device 100 can be attached to cord 405. FIGS. 5-7 further illustrates the installation steps to install clip device 100 to handheld device 401.

As shown in FIG. 5, clip device 100 is placed on case 403 with a portion of the tapered end of clip device 100 protruding through an opening of case 403. The opening of case 403 can be any openings, such as an opening of a physical port (e.g., a charging port, a microphone/headphone port, audio speaker, and/or buttons) corresponding to handheld device 401, etc.

Figure 8:
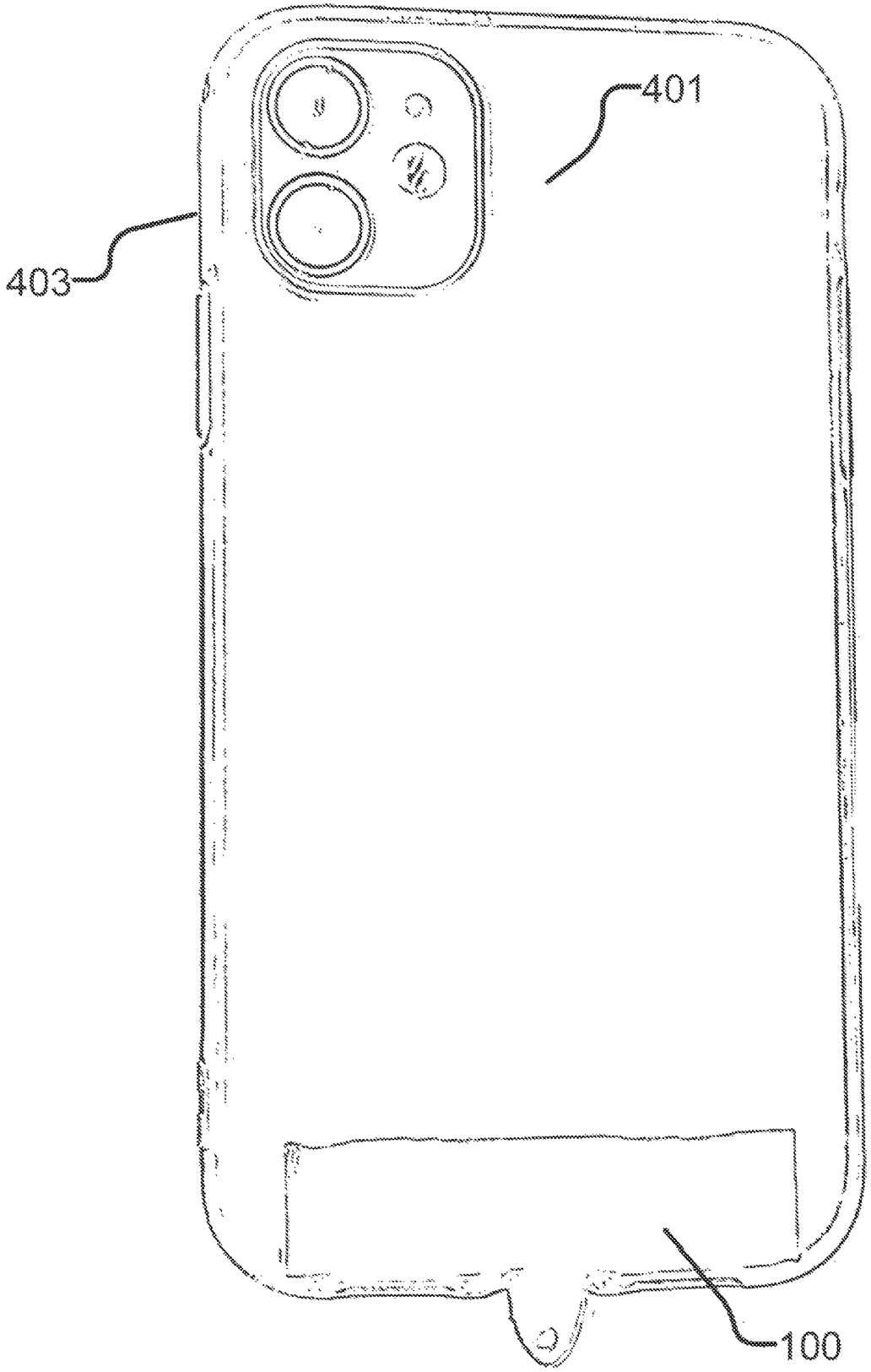
FIG. 8 illustrates a back view of the handheld device and case attached to the clip device according to one embodiment.

Next, as shown in FIG. 6, handheld device 401 is fitted onto case 403 sandwiching clip device 100 between handheld device 401 and case 403. As shown in FIGS. 7-8, once fitted, clip device 100 is secured to handheld device 401 via case 403. For some scenarios, clip device 100 does not interfere with a utility of the physical port. E.g., if clip device 100 protrudes through an opening of case 403 and the opening is for a charging port, handheld device 401 can be charged via charging port at the same time with clip device 100 installed.

Figure 9:
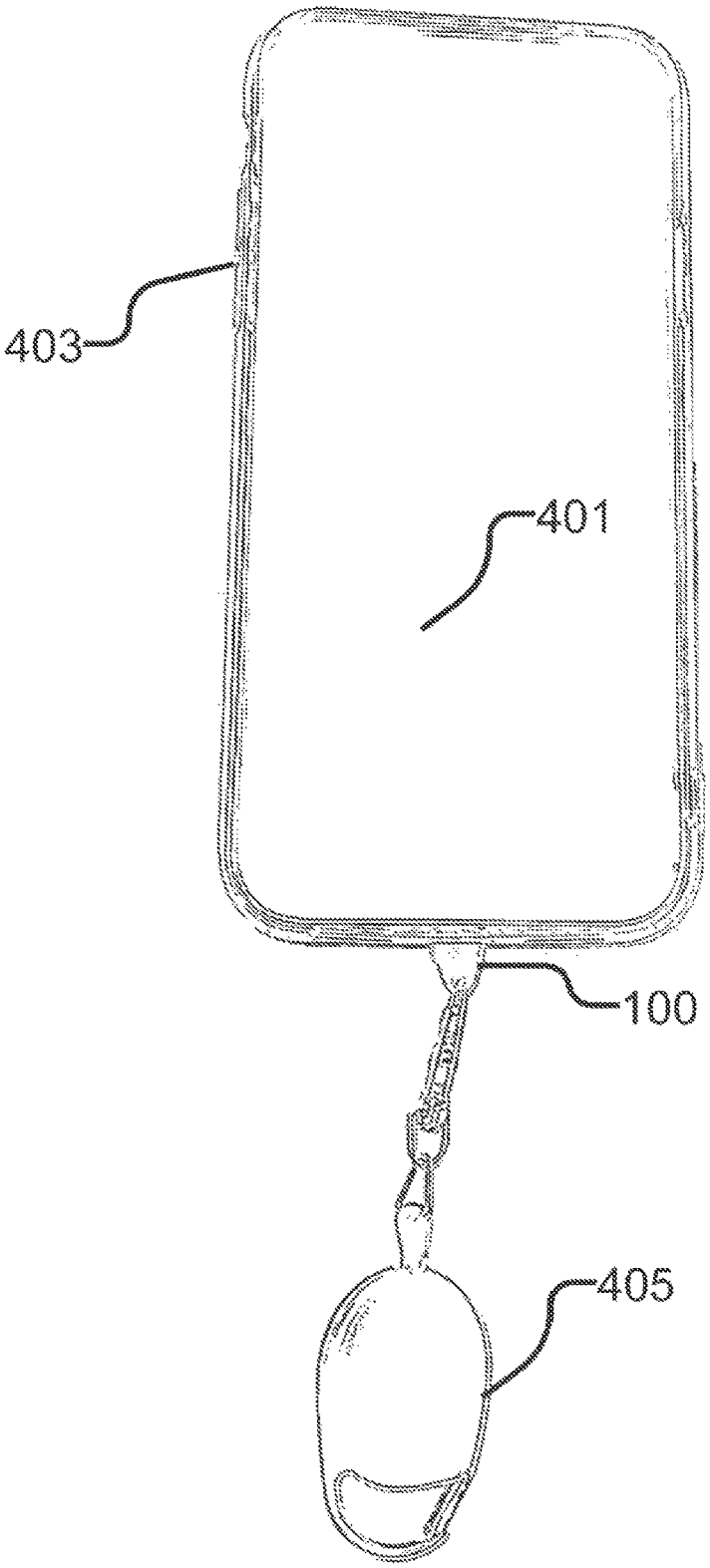
FIG. 9 illustrates a clip extension (clip device and retractable cord) attached to the handheld device according to one embodiment.
Figure 10:
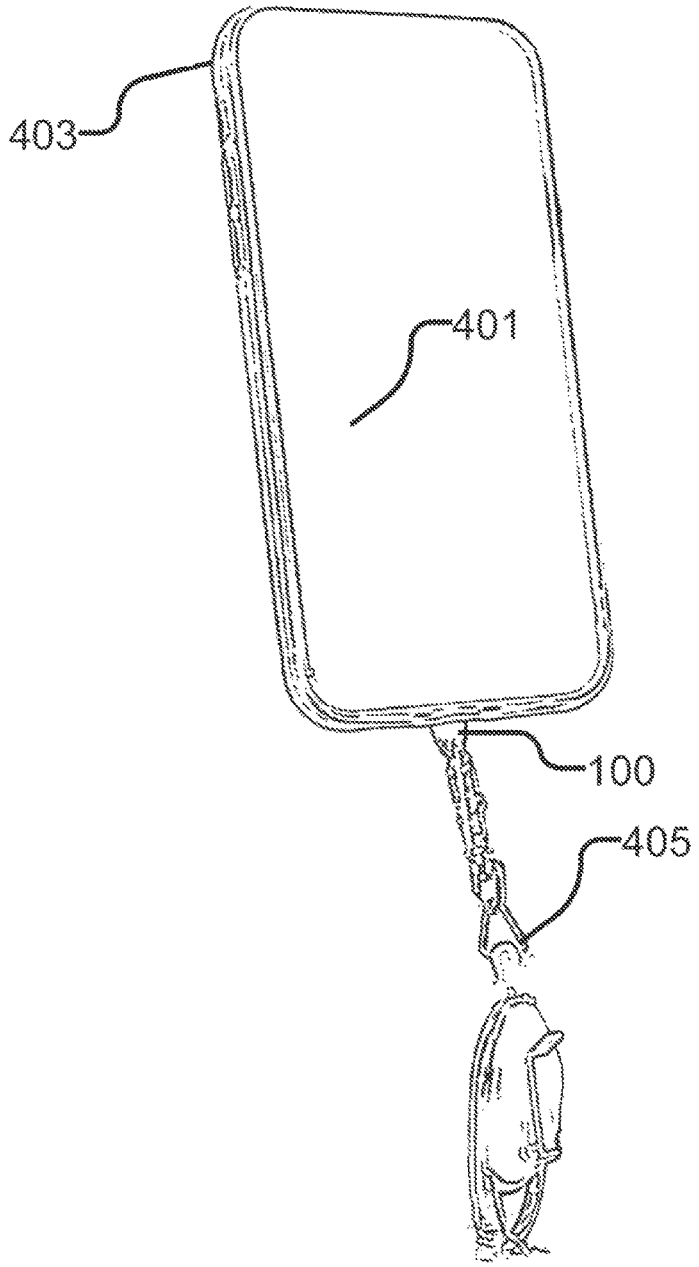
FIG. 10 illustrates a clip extension (clip device and retractable cord) attached to the handheld device and an article of clothing according to one embodiment.

FIG. 9 illustrates a clip extension (clip device and retractable cord) attached to the handheld device according to one embodiment. As shown, once clip device 100 is attached to handheld device 401, where clip device 100 can be clipped to one end of cord 405, using an alligator clip/key chain clip/hook attached to cord 405, or having cord 405 directly looped through hole 105. As shown in FIG. 10, another end of cord 405 can be attached to an article of clothing 1001 of a person, such as a purse, shirt, pants, and/or a belt.

Thus, even with a bar form factor, because handheld device 401 is attached to an article of clothing via clip device 101, a person is reminded not to misplace, drop, or have the handheld device stolen.

The previous description of the disclosed embodiments is provided to enable one to make or use the methods, device or article of the present disclosure. Various modifications to these embodiments will be readily apparent, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A clip device, comprising:

a flat membrane body having 6 sides, wherein the top and bottom sides are the portions having the largest surface area, wherein the left and right sides being the shorter lengths, and wherein the front and back sides being the longer lengths; and a thickened tab monolithically formed to the membrane body, wherein the thickened tab only extends from the front of the membrane and the top of the membrane, wherein the thickened tab is clipped to a retractable cord that is wound about a spool, wherein the flat surface of the membrane body is sandwiched between a case of a handheld device and the handheld device, and wherein the thickened tab is protruding through an opening of the case.

2. The clip device of claim 1, wherein the thickened tab includes a hole that is clipped to the retractable cord by inserting a portion of the retractable cord through the hole of the thickened tab.

3. The clip device of claim 1, wherein the thickened tab includes a connection for an alligator clip and the alligator clip is clipped to a portion of the retractable cord.

4. The clip device of claim 1, wherein the membrane body is rectangular shaped, and the rectangular shape is sandwiched between the case of the handheld device and the handheld device.

5. The clip device of claim 1, wherein a thickness of the portion of the thickened tab thickens only towards the front and the top side of the membrane body.

6. The clip device of claim 1, wherein the thickened tab is clipped to a first end of the retractable cord and a second end of the retractable cord is attached to a secure point on a belt or bag.

* * * * *